US006056153A

United States Patent [19]

Inoue

[11] Patent Number: 6,056,153

[45] Date of Patent: May 2, 2000

[54] METHOD AND APPARATUS FOR EXTRUDING A HIGHLY VISCOUS FLUID FROM A TANK

[75] Inventor: Masakazu Inoue, Tokyo, Japan

[73] Assignee: Inoue Mfg., Inc., Japan

[21] Appl. No.: 09/149,504

[22] Filed: Sep. 8, 1998

[51] Int. Cl.[7] ..... B67D 5/46

[52] U.S. Cl. ..... 222/1; 222/387; 222/389

[58] Field of Search ..... 222/386, 387, 222/389, 325, 148, 1

[56] References Cited

U.S. PATENT DOCUMENTS

| | | | |
|---|---|---|---|
| 665,013 | 1/1901 | Jones | 222/387 |
| 3,786,966 | 1/1974 | Behunin et al. | 222/389 |
| 4,452,377 | 6/1984 | Hurley et al. | 222/148 |
| 4,630,760 | 12/1986 | Wold | 222/387 |
| 4,693,286 | 9/1987 | Lock et al. | 222/389 |
| 5,248,069 | 9/1993 | Consaga et al. | 222/389 |
| 5,361,940 | 11/1994 | Miller et al. | 222/389 |
| 5,462,207 | 10/1995 | Daraktchiev | 222/148 |

FOREIGN PATENT DOCUMENTS 7-16638 4/1995 Japan .

*Primary Examiner*—Charles R. Eloshway
*Attorney, Agent, or Firm*—Adams & Wilks

[57] ABSTRACT

A method and an apparatus for extruding a highly viscous fluid from a tank. A pressing member having an air flow path is disposed in the tank containing the highly viscous fluid and having a discharge outlet for discharging the highly viscous fluid. Air in the tank which is present between the pressing member and the highly viscous fluid is removed through the air flow path of the pressing member by moving the pressing member into the tank until the pressing member contacts the highly viscous fluid. The highly viscous fluid is then extruded from the outlet of the tank by pressing the pressing member against the highly viscous fluid. Thereafter, air is introduced through the air flow path of the pressing member into a region of the tank between the pressing member and the discharge outlet of the tank, and the air is then pressurized and ejected through the discharge outlet of the tank.

18 Claims, 3 Drawing Sheets

METHOD AND APPARATUS FOR EXTRUDING A HIGHLY VISCOUS FLUID FROM A TANK

BACKGROUND OF THE INVENTION

1. Field of the Invention

The present invention relates generally to a method and an apparatus for extruding a viscous fluid and, more specifically, to a method and an apparatus for extruding a highly or ultrahighly viscous fluid from a tank. The method and apparatus of the present invention are characterized by extruding the highly or ultrahighly viscous fluid from the tank and by cleaning the apparatus after the extrusion operation.

2. Background Information

In the production of a highly viscous or an ultrahighly viscous fluid such as ink, a coating material, a pigment, a sealing agent, a caulking agent or an adhesive, the removal of such a fluid from a stirring tank is difficult to accomplish due to the poor fluidity of the fluid. For such reason, a method and an apparatus have been used wherein after a stirring process, a pressing plate is fitted inside of the tank, and the pressing plate is moved toward the bottom of the tank to pressurize the highly viscous fluid in the tank, thereby extruding the fluid from an ejecting port or outlet disposed at the bottom of the tank.

In the foregoing extrusion method and apparatus, the pressing plate is hermetically fitted inside of the tank so that the pressing force will be securely effected on the highly viscous fluid in the tank. When the pressing plate is fitted inside of the tank, a layer of air may sometimes be present between the highly viscous fluid and the pressing plate. When such layer of air is present, the pressing force of the pressing plate is effected on the highly viscous fluid through the layer of air, whereby the extrusion operation becomes highly difficult to achieve. Furthermore, after the termination of the extrusion operation, when the pressing plate is pulled up (i.e., removed from the tank), since the interior of the tank is in an approximate vacuum state, it is extremely difficult to remove the pressing plate from the tank. Furthermore, if the highly viscous fluid remains adhered to or clogged in the outlet of the tank and/or in valves or pipes connected to the outlet of the tank, a tank cleaning operation becomes laborious and time consuming. Such laborious and time consuming cleaning operation lowers the efficiency of the extrusion method and apparatus, thereby rendering difficult the production of different types of products such as, for example, producing different color ink products.

SUMMARY OF THE INVENTION

It is an object of the present invention to provide a method for extruding a highly viscous or an ultrahighly viscous fluid from a tank by an improved smooth and consistent extrusion operation. According to the present invention, during extrusion of the viscous fluid from the tank, a pressing member can be moved smoothly inside of the tank to effect extrusion of the viscous fluid through a discharge outlet of the tank. After completion of the extrusion operation, cleaning of the tank, including removal of viscous fluid which adheres to or clogs the discharge outlet of the tank, can be conducted quickly and effectively.

Another object of the present invention is to provide an apparatus for the method for extruding the highly viscous or ultrahighly viscous fluid from the tank.

The foregoing and other objects of the present invention are carried out by a method for extruding a highly viscous fluid from a tank comprising the steps of providing a pressing member having an air flow path, disposing the pressing member in the tank for extruding the highly viscous fluid from a discharge outlet of the tank, removing air in the tank which is present between the pressing member and the highly viscous fluid through the air flow path of the pressing member by moving the pressing member into the tank until the pressing member contacts the highly viscous fluid, extruding the highly viscous fluid from the discharge outlet of the tank by pressing the pressing member against the highly viscous fluid, introducing air through the air flow path of the pressing member into a region of the tank between the pressing member and the discharge outlet of the tank, and pressurizing the air introduced in the tank to eject the introduced air through the discharge outlet of the tank.

In one embodiment, the pressurizing step comprises supplying compressed air into the region of the tank through the air flow path. In another embodiment, the introducing step includes withdrawing the pressing member from the tank to a predetermined distance from the discharge outlet of the tank to introduce air into the region of the tank through the air flow path, and the pressurizing step comprises pressing down the pressing member to eject the introduced air through the discharge outlet of the tank.

In another aspect, the present invention is directed to an apparatus for extruding a highly viscous fluid from a tank. The apparatus comprises a tank for containing a highly viscous fluid and having a discharge outlet for discharging the highly viscous fluid from the tank, and a pressing member for movement inside of the tank in a first direction for pressing the highly viscous fluid to extrude the highly viscous fluid from the discharge outlet of the tank, and for movement in a second direction opposite the first direction. The pressing member has a first surface, a second surface opposite the first surface for pressing the highly viscous fluid, an air flow path extending through the pressing member from the first surface to the second surface, and a valve movable between an open position and a closed position to open and close the air flow path, respectively.

The apparatus according to the present invention further comprises means for introducing air into the tank through the air flow path of the pressing member, and ejecting means for ejecting the introduced air from the discharge outlet of the tank. In one embodiment, the ejecting means comprises an air compressor connected in fluid communication with tank via the air flow path.

The pressing member of the apparatus according to the present invention has a biasing member for biasing the valve to the open position. Preferably, the biasing member comprises a spring. The valve preferably comprises a disc having a generally cone-shaped upper surface and a generally flat-shaped lower surface.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

While this invention is susceptible of embodiments in many different forms, this specification and the accompanying drawings disclose only preferred embodiments of the invention. The invention is not intended to be limited to the embodiments so described, and the scope of the invention will be pointed out in the appended claims.

The preferred embodiments of the present invention will be described below with reference to FIGS. 1–6, wherein like numerals designate like elements throughout the various figures.

Figure 1:
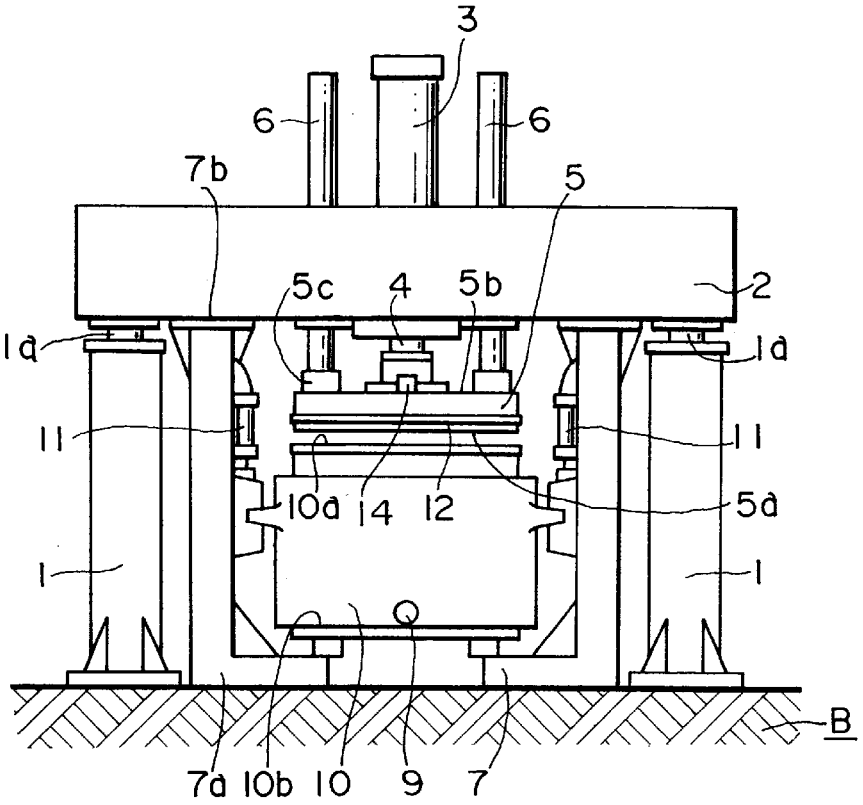
FIG. 1 is a front view of an apparatus according to the present invention for extruding a highly viscous fluid.

FIG. 1 shows a front view of an apparatus according to the present invention for extruding a highly or an ultrahighly viscous fluid from a tank. A pair of hydraulic cylinders 1 are supported on a fixed base B. Each of the hydraulic cylinders 1 has an extendable rod 1*a* for extension from and retraction into the hydraulic cylinder. In the embodiment shown in FIG. 1, extension of the rods 1*a* from the hydraulic cylinder 1 is directed in an upward direction (i.e., away from the fixed base B), and retraction of the rods 1*a* is directed in a downward direction (i.e., towards the fixed base B).

A base member or head 2 is supported and can be lifted or lowered by the hydraulic cylinders 1 relative to the fixed base B. A fluid pressure cylinder 3, such as a hydraulic cylinder or an air cylinder, is mounted on the head 2 and has an extendable rod 4 for extension from and retraction into the fluid pressure cylinder 3. A pressing member or plate 5 has a first surface or pressing face 5*a*, and a second surface 5*b* opposite the pressing face 5*a* integrally connected to one end of the rod 4 of the fluid pressure cylinder 3. The pressing plate 5 has a pair of mounting blocks 5*c* integrally connected to a pair of guide members or rods 6, respectively. The guide rods 6 are mounted on the head 2 for sliding movement in a first direction towards the fixed base B and in a second direction away from the fixed base B. By this construction, the pressing plate 5 can be moved in the first direction and in the second direction under the guidance of the guide rods 6 upon pressurization of the fluid pressure cylinder 3.

A tank base 7 has a lower portion 7*a* disposed on the fixed base B and an upper portion 7*b* providing further support for the head 2. A tank 10 for containing a highly viscous or an ultrahighly viscous fluid 8 (FIG. 2) is mounted on the lower portion 7*a* of the tank base 7. The tank 10 has an open end 10*a*, a closed end having a base 10*b*, and a discharge aperture or outlet 9 at the closed end for discharging the viscous fluid from the tank. The tank 10 is supported by hydraulic cylinders 11 which suitably position and prevent the tank from moving. A valve (not shown) or a spout which opens outwardly (not shown) is connected to the outlet 9 for opening and closing the outlet 9.

Figure 2:
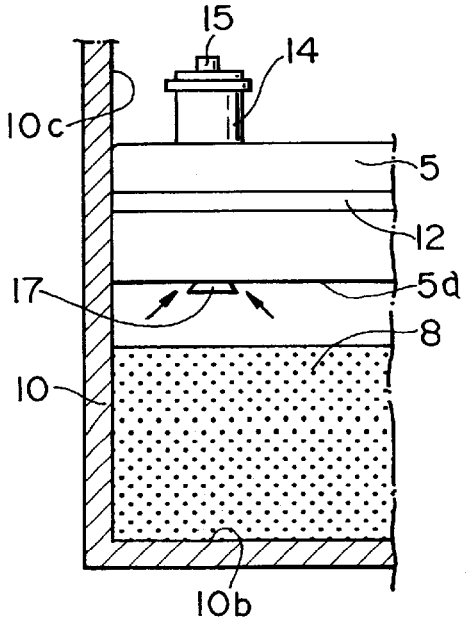
FIG. 2 is a partial sectional view showing a part of a tank and a pressing member of the apparatus according to the present invention.

Referring to FIGS. 1 and 2, the open end 10*a* of the tank 10 is positioned directly below the pressing plate 5 in confronting, aligned relation therewith. The pressing plate 5 has an outer perimeter which is smaller than an interior perimeter of the tank 10. By this construction, the pressing plate 5 can be fitted into and lifted from the tank 10 when the pressing plate 5 is moved in the first and second directions, respectively.

An elastic member 12 is disposed around an outer peripheral surface of the pressing plate 5 for providing an air-tight seal between the pressing plate 5 and an inner side wall 10*c* of the tank 10 to prevent air from entering into a space in the tank 10 defined by the pressing face 5*a* of the pressing plate 5 and the inner side wall 10*c* and the base 10*b* of the tank 10 when the pressing plate 5 is fitted inside of the tank and moved in the first and second directions. More specifically, as shown in FIG. 2, when the pressing plate 5 is fitted inside of the tank 10 and moved in the first and second directions, the elastic member 12 is elastically pressed against the inner side wall 10*c* of the tank to provide an air-tight seal for maintaining the space in the tank 10 defined by the pressing face 5*a* of the pressing plate 5 and the inner side wall 10*c* and the base 10*b* of the tank 10 in a hermetically sealed state.

The elastic member 12 is preferably formed from an elastic material, such as synthetic rubber. However, it is understood by those of ordinary skill in the art that other materials which provide an air-tight seal between the pressing plate 5 and the inner side wall 10*c* of the tank 10 are suitable for the elastic member 12.

Figure 3:
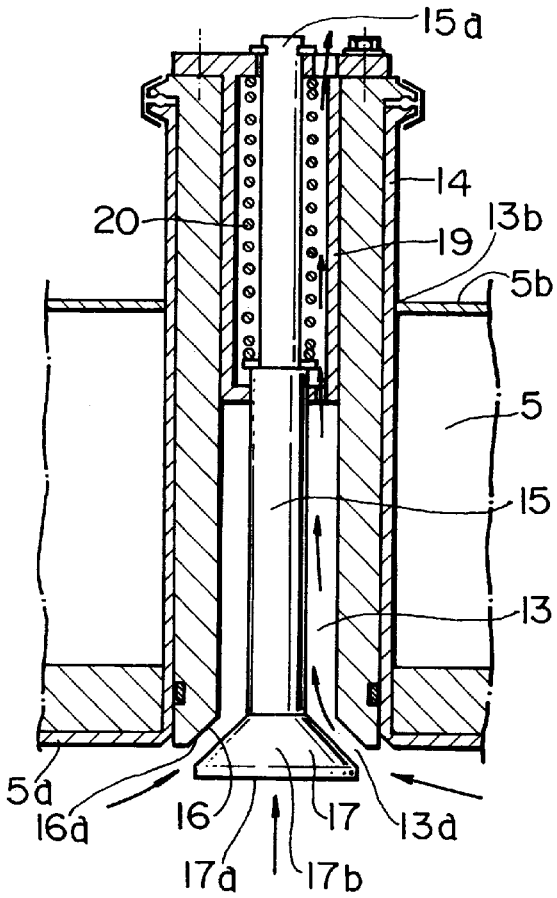
FIG. 3 is a sectional view showing an air flow path and an air control valve disposed in a pressing member according to the present invention.

Referring now to FIG. 3, a passage defining an air flow path 13 extends completely through the pressing plate 5 from the pressing face 5*a* to the second surface 5*b* of the pressing plate 5. The air flow path 13 has a first open end 13*a* at the side of the pressing face 5*a* and a second open end 13*b* at the side of the second surface 5*b*. An air control valve 14 is disposed in the air flow path 13 for controlling air flowing into and out of the tank 10 via the air flow path 13.

The air control valve 14 has a valve stem 15 disposed in the air flow path 13 for movement relative to the pressing plate 5 in the first direction (i.e., into the tank) and in the second direction (i.e., out of the tank). A valve member 17 is integrally connected to an end of the valve stem 15 for opening and closing the first open end 13*a* of the air flow path 13 during movement of the valve stem 15 in the first and second directions. More specifically, a valve seat 16 is provided at one end of the air control valve 14 proximate the pressing face 5*a* of the pressing plate 5. The valve member 17 is brought into fluid-tight or hermetic contact with the valve seat 16 (closed position) when the valve stem 15 is moved in the second direction relative to the pressing plate 5 to close the first open end 13*a* of the air flow path 13. When the valve stem 15 is moved relative to the pressing plate 5 in the first direction, the valve member 17 is withdrawn from contact with the valve seat 16 (open position) to open the first open end 13*a* of the air flow path. Preferably, the valve member 17 has a generally flat-shaped surface 17*a* which is disposed flush with the pressing face 5*a* of the pressing plate 5 when the valve member 17 is in the closed position.

Preferably, the contacting surfaces of the valve seat 16 and the valve member 17 have conforming shapes which insure the provision of a hermetic seal when the valve member 17 is in the closed position. For example, as shown in FIG. 3, the valve member 17 has a generally conical-shaped surface 17*b* and the valve seat 16 has a conforming, generally reverse cone-shaped surface 16*a*. However, it will be understood by those of ordinary skill in the art that other configurations for the contact surfaces of the valve seat 16 and the valve member 17 are suitable so long as a hermetic seal is provided by these contacting surfaces when the valve member 17 is in the closed position.

The valve stem 15 is disposed in and supported by a support frame 19 of the air control valve 14 for movement in the first and second directions relative to the support frame 19. A biasing member 20 is disposed between the valve stem 15 and the support frame 19 for applying a biasing force to the valve stem 15 in the first direction (i.e., downward direction in FIG. 3), thereby biasing the valve member 17 to the open position. In the embodiments described herein, the biasing member 20 comprises a compression spring. However, it will be understood by those of ordinary skill in the art that other biasing members, such as a fluid pressure cylinder in the form of a hydraulic or air pressure cylinder, are suitable for biasing the valve stem 15 and the valve member 17 to the open position.

Thus it will be appreciated from the foregoing construction of the apparatus for extruding the highly viscous fluid 8 from the tank 10 that when the pressing plate 5 is fitted inside the tank 10 and the valve member 17 is in the open position, the air flow path 13 is open. In this state, the space in the tank 10 defined by the pressing face 5*a* of the pressing plate 5 and the inner side wall 10*c* and the base 10*b* of the tank is in fluid communication with the air outside of tank via the air flow path 13 so that air in the tank is exhausted to the outside via the air flow path 13 when the pressing plate 5 is lowered into the tank. As shown by the arrows in FIG. 3, air exhausted from the tank 10 flows serially through the open end 13*a* of the air flow path 13 and through openings (not numbered) in the tubular housing which houses the biasing member 20 to the atmosphere. In contrast, when the valve member 17 is in the closed position, the air flow path 13 is closed and air is prevented from entering into or being exhausted from the tank 10, thereby maintaining the space in the tank 10 defined by the pressing face 5*a* of the pressing plate 5 and the inner side wall 10*c* and the base 10*b* of the tank 10 in a hermetically sealed state.

The biasing member 20 imparts a biasing force to the valve stem 15 at such a level that when the pressing plate 5 is moved in the first direction (i.e., lowered into the tank), at the initial stage of the extrusion operation, the valve member 17 will not be moved to the closed position by the air stream which flows to the outside through the air flow path 13 between the valve member 17 and the valve seat 16. In contrast, the biasing member 20 imparts a biasing force to the valve stem 15 which is weaker than the force generated by the viscosity of the highly viscous or ultrahighly viscous fluid 8 in the tank 10. Thus when the pressing plate 5 is further lowered and the valve member 17 is brought into contact with the viscous fluid 8, the force against the face of the valve member 17 generated by the viscosity of the fluid 8 will dominate the counter force applied on the viscous fluid 8 by the valve member 17 due to the biasing force of the spring 20, whereby the valve member 17 is prevented from further lowering into the tank 10 relative to the pressing plate 5 and is moved to the closed position.

Figure 4:
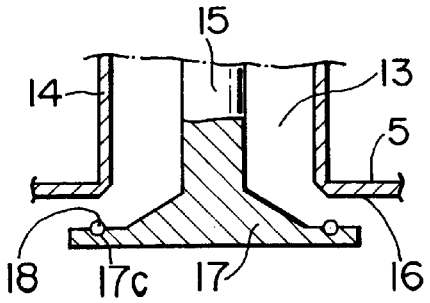
FIG. 4 is a sectional view showing another embodiment of the air control valve according to the present invention.

Another embodiment of the apparatus for extruding a highly viscous fluid from a tank, as shown in FIG. 4, comprises all of the elements set forth above for the embodiment of FIGS. 1–3. However, in the embodiment of FIG. 4, an elastic member 18, such as an O-ring, is disposed in a groove 17*c* of the valve member 17. When the valve member 17 is in the closed position, the elastic member 18 abuts the valve seat 16 to provide an airtight seal to maintain the interior volume of the tank 10 defined between the pressing face 5*a* of the pressing plate 5 and the inner side wall 10*c* and the base 10*b* of the tank in a hermetically sealed state.

Preferably, the elastic member 18 is formed from an elastic material, such as synthetic rubber. However, it is understood by those of ordinary skill in the art that other materials which provides an air-tight seal to maintain the interior volume of the tank 10 defined between the pressing face 5*a* of the pressing plate 5 and the inner side wall 10*c* and the base 10*b* of the tank in a hermetically sealed state are suitable.

An extrusion method using the extrusion apparatus according to the present invention will now be described.

The pressing plate 5 is hermetically fitted into the tank 10 containing the highly viscous or ultrahighly viscous liquid 8, such as ink, under the guidance of the guide rods 6 by pressurization of the fluid pressure cylinder 3. When the pressing plate 5 is initially pressed down (i.e., in the first direction) to extrude the viscous fluid 8 from the tank through the outlet 9, since the valve member 17 of the air control valve 14 is in the open position under the bias of the biasing member 20 and the air flow path 13 is open, the air in the tank 10 is exhausted outside through the air flow path 13, and the pressing plate 5 can be lowered smoothly into the tank 10.

Upon further lowering of the pressing plate 5 into the tank 10, when the pressing face 5*a* of the pressing plate 5 approaches the surface of the viscous fluid 8, the valve member 17, which is in the open position and protrudes from the pressing face 5*a*, contacts the viscous fluid 8 first. When the valve member 17 contacts the viscous fluid 8, the viscous fluid exerts an upward force on the surface 17*a* of the valve member 17. Since the viscosity of the viscous fluid 8 is high, the upward force applied by the viscous fluid 8 on the valve member 17 prevents the valve member 17 from further lowering into the tank 10 relative to the pressing plate 5. As a result, when the pressing plate 5 is further lowered into the tank 10, the upward force exerted by the viscous fluid 8 moves the valve member 17 upwardly to the closed position to close the air flow path 13. At this stage, the space in the tank 10 defined by the pressing face 5*a* of the pressing plate 5 and the inner side wall 10*c* and the base 10*b* of the tank 10, which is occupied by the viscous fluid 8, is in a vacuum condition or a hermetically sealed state.

Upon further lowering of the pressing plate 5 into the tank 10, the pressing face 5*a* of the pressing plate and the surface 17*a* of the valve member 17, which is flush with the pressing face 5*a*, apply uniform pressure directly against the viscous fluid 8 to thereby extrude the viscous fluid 8 from the outlet 9 of the tank.

After completion of the extrusion operation, the space in the tank 10 defined by the pressing face 5*a* of the pressing plate 5 and the inner side wall 10*c* and the base 10*b* of the tank 10 is substantially in a vacuum state. When the pressing plate 5 is lifted from the tank 10 (i.e., moved in the second direction) the valve member 17 moves downwardly to the open position under the bias of the biasing member 20, thereby opening the air flow path 13. As a result, air from outside of the tank 10 will enter the tank through the air flow path 13, thereby releasing the vacuum condition inside of the tank, and the pressing plate 5 can then be continuously lifted from the tank easily without resistance.

Figure 5:
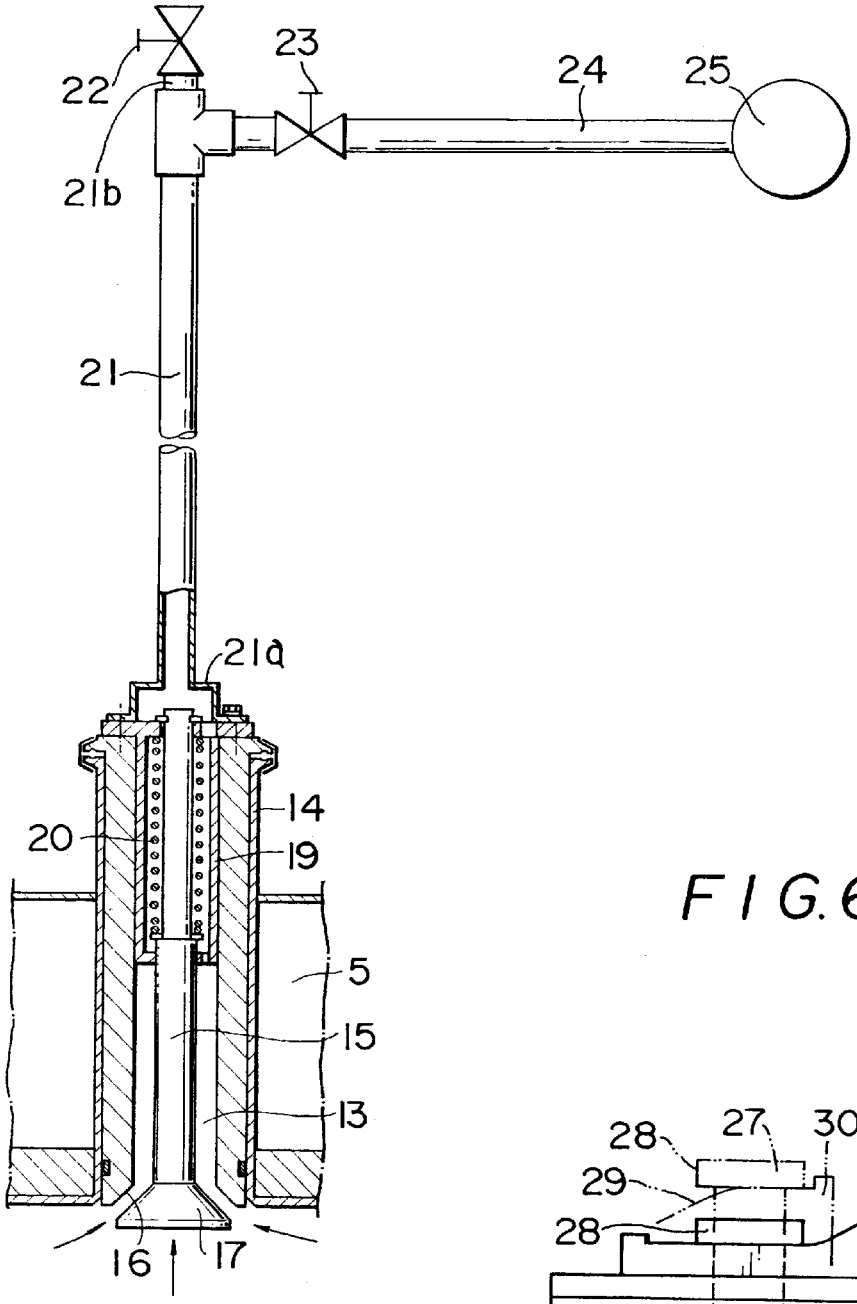
FIG. 5 is an explanatory view showing another embodiment of the apparatus according to the present invention for extruding a highly viscous fluid from a tank.
Figure 6:
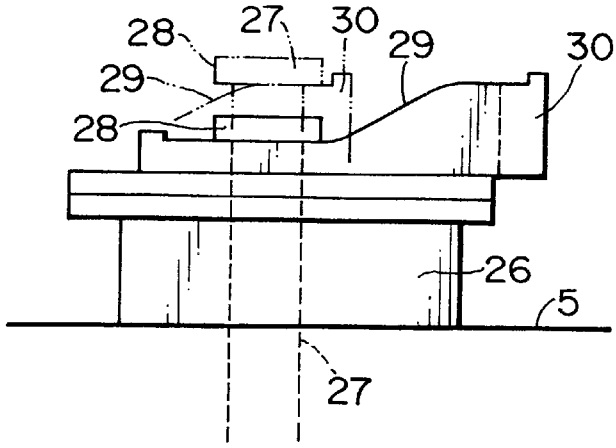
FIG. 6 is a partial side view showing another embodiment of the apparatus according to the present invention for extruding a highly viscous fluid from a tank.

FIGS. 5 and 6 show other embodiments of the method and apparatus according to the present invention by which air is introduced into the tank 10 after completion of the extrusion operation and the introduced air is pressurized and ejected from the outlet 9 of the tank to effectively remove viscous fluid which remains adhered to or clogged in the outlet of the tank.

The embodiment of the apparatus for extruding a highly viscous fluid from a tank shown in FIG. 5 comprises all of the elements set forth above for the embodiment of FIGS. 1–3 or the embodiment of FIG. 4. However, the apparatus in the embodiment of FIG. 5 further comprises an ejecting mechanism for pressurizing air introduced into the tank 10 through the air flow path 13 and ejecting the air through the outlet 9 of the tank 10. The ejecting mechanism comprises a first conduit 21 having a first end 21*a* connected to the air control valve 14 in fluid communication with the air flow path 13, and a second end 21*b* connected to a valve 22 for opening and closing the first conduit 21 to the outside air. An air compressor 25 is connected in fluid communication to the first conduit 21 via a valve 23 and a second conduit 24.

The operation of the ejecting mechanism according to the embodiment shown in FIG. 5 will now be described. While the pressing plate 5 is lowered into the tank 10 during the extrusion operation, and while the pressing plate 5 is initially lifted from the tank 10 after the extrusion operation so that the valve member 17 is maintained in the open position under the bias of the spring 20 to open the air flow path 13, as set forth above for the embodiment of FIGS. 1–3, the valve 22 is opened and the valve 23 is closed. After the pressing plate 5 has been lifted a predetermined distance from the base 10*b* of the tank, such as 1 cm, the valve 22 is closed and the valve 23 is opened. Highly compressed air is then introduced into the tank 10 by the air compressor 25 via the conduit 24, the conduit 21 and the air flow path 13. The highly compressed air introduced into the tank 10 by the air compressor 25 is ejected from the outlet 9 of the tank, and any viscous fluid which remains adhered to or clogged in the outlet 9 or a valve connected to the outlet 9 after the extrusion operation is effectively blown out of the outlet 9. By this method and apparatus, an operation for cleaning the tank can be conducted automatically and efficiently.

Preferably, the pressing plate 5 is stopped (i.e., not being lifted from the tank 10) during introduction of the compressed air into the tank 10. Alternatively, the compressed air may be introduced into the tank 10 while the pressing plate 10 is being lifted from the tank 10.

In the embodiment shown in FIG. 6, an air control valve 26 and a valve stem 27 have substantially the same structure as the air control valve 14 and the valve stem 15 described above for the embodiments of FIGS. 1–3. However, in the embodiment of FIG. 6, a control member 30 is connected to the air control valve 26 for opening and closing the air flow path 13. The control member 30 has a cam surface 29 engaging an upper end 28 of the valve stem 27 which is connected to the valve member 17 in the manner set forth above for the valve stem 15 of the embodiments of FIGS. 1–3. The control member 30 is movable between an operating position shown in dotted line in FIG. 6, and a non-operating position shown in solid line in FIG. 6. In the operating position, the control member 30 maintains the valve member 17 in the closed position to close the air flow path 13. In the non-operating position, the control member 30 allows the valve stem 27, and thus the valve member 17, to move freely in the first direction (i.e., downward in FIG. 6) and in second direction (i.e., upward in FIG. 6).

The operation of the ejecting mechanism according to the embodiment shown in FIG. 6 will now be described. When the viscous fluid 8 in the tank 10 is to be extruded, the control member 30 is positioned at the non-operating position, so that the valve stem 27 can be moved upward and downward freely as set forth above for the embodiments of FIGS. 1–3. After completion of the extrusion operation, when the pressing plate 5 is lifted and the valve member 17 is moved to the open position under the bias of the biasing member 20 to let a substantial amount of air enter the tank 10 through the air flow path 13, the movement of the pressing plate 5 is suspended. The control member 30 is then moved to the operating position so that the valve member 17 closes the air flow path 13. While maintaining this state, the pressing plate 5 is then rapidly lowered toward the base 10*b* of the tank 10 so that the air contained in the tank is pressurized and ejected from the outlet 9. By the ejection of the pressurize air through the outlet 9 of tank 10, any viscous fluid which remains adhered to or clogged in the outlet 9 or a valve connected to the outlet 9 of the tank after the extrusion operation is effectively blown out of the outlet 9. By this method and apparatus, an operation for cleaning the tank can be conducted automatically and efficiently.

After the cleaning operation, the control member 30 is returned to the non-operating position, whereby the valve member 17 is moved to the open position to open the air flow path 13. The pressing plate 5 can then be continuously lifted out of the tank 10 as set forth above for the embodiments of FIGS. 1–3.

The ejecting mechanism according to the present invention may be modified without departing from the spirit and scope of the present invention. For example, after completion of the extrusion operation in the embodiment of FIG. 5, and after the pressing plate 5 is lifted and the valve member 17 is moved to the open position under the bias of the biasing member 20 to let a substantial amount of air enter the tank 10 through the air flow path 13, the valves 22 and 23 are closed and the pressing plate 5 is rapidly lowered toward the base 10*b* of the tank 10 so that the air contained in the tank is pressurized and ejected from the outlet 9. By this modification, the pressurized air can be ejected from the outlet 9 of the tank without necessitating the introduction of compressed air from the air compressor 25.

In the foregoing embodiments of the method and apparatus according to the present invention, a biasing member 20 is used to bias the valve member 17 to the open position. In an alternative embodiment, the biasing member 20 is omitted, and gravitation may provide the force required to displace the valve member 17 to the open position by properly selecting the combined weight of the valve stem 15 and valve member 17. More specifically, the combined weight of the valve stem 15 and the valve member 17 is selected such that, at the initial stage of the extrusion operation, the gravitational force resulting from the combined weight is greater than the force exerted on the valve stem 15 and the valve member 17 by the air stream which flows to the outside through the air flow path 13 between the valve member 17 and the valve seat 16 to thereby prevent movement of the valve member 17 to the closed position. In contrast, the gravitational force resulting from the selected combined weight of the valve stem 15 and the valve member 17 should be less than the force generated by the viscosity of the highly viscous fluid 8 in the tank 10 to thereby allow the valve member 17 to be moved to the closed position.

By the foregoing embodiments of the method and apparatus according to the present invention, when the pressing plate is lowered into the tank, the air between the highly viscous fluid and the pressing plate is exhausted through the air flow path of the air control valve, thereby allowing the pressing plate to reach the surface of the viscous fluid easily and without resistance. When the pressing plate reaches the surface of the viscous fluid and is further moved downward into the tank, the pressing plate receives a pressing force from the viscous fluid and the valve member of the air control valve is moved to the closed position to close the air flow path. Thereafter, further downward pressure is applied to the pressing plate against the viscous fluid until the viscous fluid is completely extruded from the outlet of the tank.

After the extrusion operation, the inside of the tank is in a substantially vacuum condition. When the pressing plate is lifted from the tank, the air flow path of the air control valve is opened, air enters the tank through the air flow path, and the vacuum condition is released, whereby the pressing plate can then be lifted easily and continuously without resistance. Thereafter, when the air introduced into the tank is pressurized, the air is ejected from the outlet of the tank, and highly viscous fluid which adheres to or clogs the outlet and/or a valve connected to the outlet of the tank is effectively blown out of the tank, thereby automatically and efficiently cleaning the outlet of the tank.

Thus the present invention provides a method and an apparatus for extruding a highly viscous or an ultrahighly viscous fluid from a tank by an improved smooth and consistent extrusion operation. According to the present invention, during extrusion of the viscous fluid from the tank, the pressing plate can be moved smoothly inside of the tank to effect extrusion of the viscous fluid through the outlet of the tank. After completion of the extrusion operation, cleaning of the tank, including removal of viscous fluid which adheres to and around the outlet of the tank, can be conducted quickly and effectively.

From the foregoing description, it can be seen that the present invention comprises an improved method and an improved apparatus for extruding a highly viscous or ultrahighly viscous fluid from a tank. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed is:

1. A method for extruding a highly viscous fluid from a tank, comprising the steps of: disposing a pressing member in a tank containing a highly viscous fluid and having a discharge outlet for discharging the highly viscous fluid; removing air from the tank which is present between the pressing member and the highly viscous fluid by moving the pressing member in the tank until the pressing member contacts the highly viscous fluid; extruding the highly viscous fluid from the discharge outlet of the tank by pressing the pressing member against the highly viscous fluid; introducing air into a region of the tank between the pressing member and the discharge outlet of the tank; and pressurizing the air introduced into the tank to eject the introduced air through the discharge outlet of the tank.

2. A method according to claim 1; wherein the introducing step includes withdrawing the pressing member from the tank to a predetermined distance from the discharge outlet of the tank to introduce air into the region of the tank.

3. A method according to claim 1; wherein the pressurizing step comprises supplying compressed air into the region of the tank.

4. A method according to claim 1; wherein the introducing step includes withdrawing the pressing member from the tank to a predetermined distance from the discharge outlet of the tank to introduce air into the region of the tank; and wherein the pressurizing step comprises pressing the pressing member downwardly to eject the introduced air through the discharge outlet of the tank.

5. A method according to claim 1; wherein the pressing member has an air flow path; and wherein the introducing step includes introducing air into the region of the tank through the air flow path.

6. A method according to claim 5; wherein the introducing step includes withdrawing the pressing member from the tank to a predetermined distance from the discharge outlet of the tank to introduce air into the region of the tank through the air flow path.

7. A method according to claim 6; including the step of closing the air flow path of the pressing member before the pressurizing step; and wherein the pressurizing step comprises pressing the pressing member downwardly to eject the introduced air through the discharge outlet of the tank.

8. A method according to claim 5; wherein the pressurizing step comprises supplying compressed air into the region of the tank through the air flow path.

9. A method according to claim 1; wherein the pressing member has an air flow path; and wherein the removing step comprises removing the air in the tank which is present between the pressing member and the highly viscous fluid through the air flow path.

10. A method according to claim 9; including the step of closing the air flow path of the pressing member before the extruding step.

11. A method according to claim 10; wherein the closing step comprises closing the air flow path of the pressing member by bringing the pressing member into contact with the highly viscous fluid during the removing step.

12. A method for extruding a highly viscous fluid from a tank, comprising the steps of: providing a pressing member having an air flow path; disposing the pressing member in a tank containing a highly viscous fluid and having a discharge outlet for discharging the highly viscous fluid; removing air in the tank which is present between the pressing member and the highly viscous fluid through the air flow path of the pressing member by moving the pressing member into the tank until the pressing member contacts the highly viscous fluid; extruding the highly viscous fluid from the outlet of the tank by pressing the pressing member against the highly viscous fluid; introducing air through the air flow path of the pressing member into a region of the tank between the pressing member and the discharge outlet of the tank; and pressurizing the air introduced in the tank to eject the introduced air through the discharge outlet of the tank.

13. A method according to claim 12; including the step of closing the air flow path of the pressing member before the extruding step.

14. A method according to claim 13; wherein the closing step comprises closing the air flow path of the pressing member by bringing the pressing member into contact with the highly viscous fluid during the removing step.

15. A method according to claim 12; wherein the introducing step includes withdrawing the pressing member from the tank to a predetermined distance from the discharge outlet of the tank to introduce air into the region of the tank through the air flow path.

16. A method according to claim 15; including the step of closing the flow path of the pressing member before the pressurizing step.

17. A method according to claim 16; wherein the pressurizing step includes pressing the pressing member downwardly while the air flow path is closed to eject the introduced air through the discharge outlet of the tank.

18. A method according to claim 12; wherein the pressurizing step comprises supplying compressed air into the region of the tank through the air flow path.

* * * * *